United States Patent [19]

Horii et al.

[11] Patent Number: 4,494,655

[45] Date of Patent: Jan. 22, 1985

[54] SORTER WITH AUTOMATIC REMOVAL MECHANISM

[75] Inventors: Tetsuo Horii, Kawasaki; Takeshi Kohno, Yokohama, both of Japan

[73] Assignee: Tokyo Shibaura Denki Kabushiki Kaisha, Japan

[21] Appl. No.: 349,688

[22] Filed: Feb. 17, 1982

[30] Foreign Application Priority Data

Feb. 18, 1981 [JP] Japan ..... 59-21684[U]

[51] Int. Cl.[3] ..... B07C 3/06

[52] U.S. Cl. ..... 209/569; 209/651; 209/900; 271/298; 414/46; 414/53; 414/100

[58] Field of Search ..... 209/584, 552, 534, 656, 209/651, 653, 900, 916, 569; 270/58; 271/298; 235/375; 414/46, 53, 100

[56] References Cited

U.S. PATENT DOCUMENTS

| | | | |
|---|---|---|---|
| 3,184,061 | 5/1965 | Levy | 209/900 |
| 3,567,046 | 3/1971 | Reist | 414/53 |
| 3,573,748 | 4/1971 | Holme | 414/134 |
| 3,782,541 | 12/1972 | Wood | 209/900 |
| 4,051,957 | 6/1976 | Parups | 414/53 |

FOREIGN PATENT DOCUMENTS

| | | |
|---|---|---|
| 2729830 | 11/1979 | Fed. Rep. of Germany . |
| 3008897 | 9/1980 | Fed. Rep. of Germany . |

OTHER PUBLICATIONS

Response from German Patent Office (W/Translation) Dated May 9, 1984.

*Primary Examiner*—Scherbel David A.
*Assistant Examiner*—Donald T. Hatec
*Attorney, Agent, or Firm*—Cushman, Darby & Cushman

[57] ABSTRACT

When the number of pieces of postal matter stacked at a stacking section in a sorter with an automatic push-out apparatus of the invention reaches a number which allows a push-out operation before or after a full-stack operation, the postal matter is transferred to a corresponding empty tray. The postal matter which is to be stacked at this stacking section during the push-out operation is stacked at a preliminary stacking section. After the stacking section is restored, the postal matter stacked at the preliminary stacking section is transferred to the empty tray.

1 Claim, 8 Drawing Figures

SORTER WITH AUTOMATIC REMOVAL MECHANISM

BACKGROUND OF THE INVENTION

The present invention relates to a sorter with an automatic removal apparatus which reads sorting information provided for documents such as postal matter to sort the documents and transfer them to corresponding stacking sections arranged in a plurality of stages in the vertical direction, and which automatically removes the documents at the stacking sections in unit stacks to convey them to the next step.

Various types of automatic postal matter processors are proposed in order to save labor involved in work related to mailing service. As an example, an automatic postal code number readout sorter is proposed which automatically reads the postal code numbers and automatically sorts the postal matter according to the readout postal code numbers. However, with such a conventional automatic postal code number readout sorter, the postal matter stacked at the stacking sections arranged in a plurality of stages in the vertical direction is taken out of the sections manually by the operator from one stacking section to another. The postal matter is then attached with an address card and are bound together. Therefore, one operator must always work with the sorter, and the operator must move within a wide range, exerting a big work load on the operator.

A prior art sorter is proposed in Japanese Utility Model Publication No. 52-22771. This publication proposes a removal conveying apparatus wherein the documents stacked at a feeding section are automatically removed to an outfeed section and the sides of the stacks of the documents at the outfeed sections are bound by brush-like holding members. According to this arrangement, the sliding of the stacked documents due to the vibrations or the like when the stacks of documents are fed out to the outfeed section or when they are conveyed. However, this publication does not describe a technique to feed out the stacks of documents from the outfeed section when the feed section is full of stacks of documents.

For this reason, a sorter with an automatic removal apparatus is desired which automatically removes the postal matter sorted into stacks and which sequentially feeds the stacks to an address card attaching unit and a binding unit.

The method for removing the postal matter from the stacking sections, by pushing the postal matter backward, that is, to the rear side of the sorter main body to place them on the conveyance path for conveying them to the next step, is suitable since a plurality of stacking sections are arranged in the horizontal direction. Furthermore, since the stacking sections are also arranged in a plurality of stages in the vertical direction, horizontal conveyance paths for conveying the postal matter removed from the stacking sections are also required in the corresponding number. In order to systematize the subsequent units such as the address card attaching unit and the binding unit and to effectively process the postal matter, it is preferable to join the postal matter conveyed by a plurality of horizontal convey paths.

For example, a method as shown in FIG. 1 has been recently proposed. Automatic push-out mechanisms (not shown) are arranged at respective stacking sections b, c and d of a sorter main body a. When the suitable number of pieces of postal matter is stacked, the stacks of postal matter A are pushed out backward and are placed on endless conveyer belts e, f and g arranged in correspondence with stacking sections b, c and d which are, in turn, arranged vertically at the rear side of the sorter main body a and which are arranged in a plurality of stages. The address cards are placed on the stacks of postal matter A after they are transferred to an elevator and a convey line (not shown).

However, with such a method, after the stacking sections are full of postal matter, and an empty tray is located at the corresponding location, the stack of postal matter is pushed out.

Therefore, the push-out operation is performed even if there is some postal matter on the convey path which is to be stacked at the stacking section involved in the push-out operation during the push-out time, or even if there is postal matter on the convey path which is to be rejected.

SUMMARY OF THE INVENTION

It is an object of the present invention to provide a sorter with an automatic removal apparatus which is capable of reducing the number of pieces of postal matter to be rejected during the removal operation of the documents by stacking the documents to a predetermined stacking section while the removal operation for this stacking section is performed.

In order to achieve the above object, there is provided according to the present invention a sorter with an automatic removal apparatus comprising:

(a) means for reading out sorting information on documents;

(b) a plurality of stacking sections which are arranged in a plurality of stages in the vertical direction, which stack the documents, and each of which has a removal mechanism;

(c) means for storing the documents at said plurality of stacking sections based on the sorting information read out by said reading means;

(d) preliminary stacking means having a removal mechanism for stacking the documents to be stacked to one of said stacking sections when the documents at said one stacking section are transferred to a transfer section; and (e) means for driving said the removal mechanism of said stacking section or said the removal mechanism of said preliminary stacking section so as to transfer the documents stacked at the stacking section and said preliminary stacking section to said transfer section.

According to a sorter with an automatic removal apparatus of the present invention, the documents to be stacked at a stacking section are stacked at a preliminary stacking section with a removal mechanism while the documents already stacked at this stacking section are removed, so that the number of documents to be rejected during the removal of the documents may be decreased.

BRIEF DESCRIPTION OF THE DRAWINGS

Other objects and features of the present invention will be apparent from the following description in connection with the accompanying drawings in which.

DETAILED DESCRIPTION OF THE PREFERRED EMBODIMENTS

Figure 1:
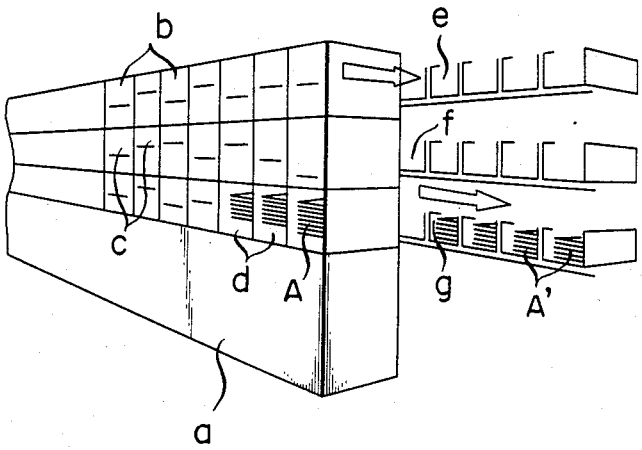
FIG. 1 (PRIOR ART)
FIG. 1 is a perspective view schematically showing the arrangement of a conventional sorter with an automatic push-out apparatus.
Figure 2:
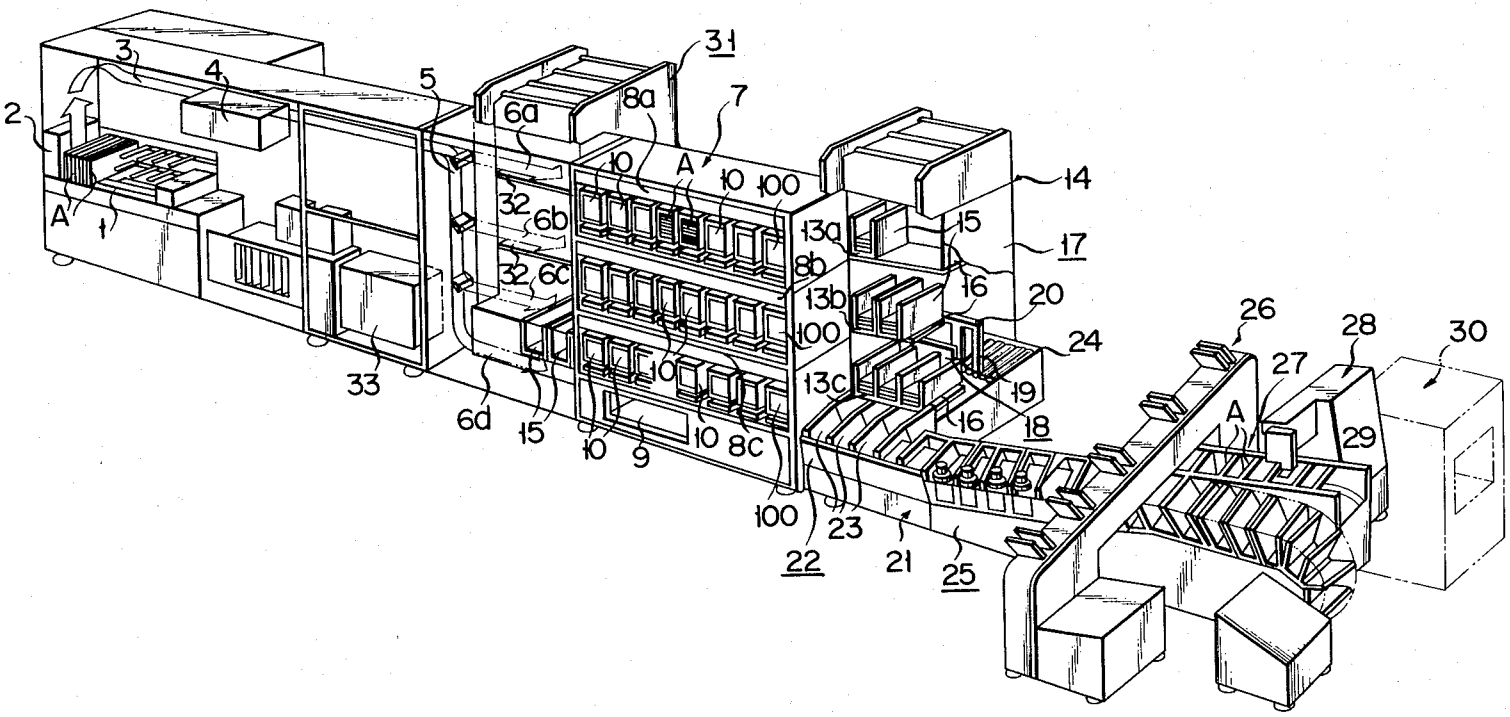
FIG. 2 is a perspective view showing a sorter with an automatic push-out apparatus according to an embodiment of the present invention.

Referring to FIG. 2, stacks of postal matter A such as cards and letters which are set under upright condition at a feeding section 1 are sequentially picked up from the front by a pickup section 2. The postal code number on the postal matter A is read out by a reading section 4 which is arranged along a feed-in convey path 3.

The postal matter A is selectively conveyed by a gate mechanism 5 to sorting convey paths 6*a*, 6*b*, 6*c* and 6*d* which are arranged in the vertical direction, according to the readout results from the reading section 4. The sorted postal matter is fed to horizontal sorting convey paths 8*a*, 8*b* and 8*c* of a sorting section 7 with an automatic push-out function or to a reject pocket 9.

In the sorting section 7 with an automatic push-out function, a plurality of stacking sections 10 are arranged along the lower surfaces of the horizontal sorting convey paths 8*a*, 8*b* and 8*c*. The postal matter A fed to the horizontal sorting convey paths 8*a*, 8*b* and 8*c* is sorted to the predetermined stacking sections 10 to be stacked therein according to the readout results of the reading section 4.

When a suitable number of pieces of postal matter A is stacked in the stacking section 10 or a compulsory push-out switch (not shown) is depressed, the push-out mechanism (to be described later) operates to push out the postal matter A inside the stacking section 10 to the rear side of the sorting section 7 with an automatic push-out function.

The preliminary stacking section 100 is arranged at the last stage of the stacking sections. The postal matter A in this preliminary stacking section 100 is pushed out to the rear side of the sorter 7 with an automatic push-out function when the push-out mechanism of the same configuration as the stacking section 10 operates after the push-out operation of the corresponding stacking section 10 is completed and this stacking section 10 is restored to the initial status (feed-in status).

A tray circulating section 14 (transferring section) in which horizontal tray convey paths 13*a*, 13*b* and 13*c* are arranged vertically in three stages in correspondence with the stacks of postal matter A is arranged at the rear side of the sorting section 7 with automatic push-out function. The stacks of postal matter A pushed out from the stacking sections 10 are transferred to trays 15 which are intermittently displaced within the horizontal tray convey paths 13*a*, 13*b* and 13*c*.

At the terminal sides of the horizontal tray convey paths 13*a*, 13*b* and 13*c*, an elevator 17 is arranged for vertically sequentially moving opposing tray mounting tables 16 to the terminal sides of the horizontal tray convey paths 13*a*, 13*b* and 13*c*. A tray 15 which has received the stack of postal matter A from the horizontal tray convey paths 13*a*, 13*b*, and 13*c* (may be empty) is circulated to the separating section of a postal matter/tray separating mechanism 18 of the next step. At the postal matter/tray separating mechanism 18, a postal matter push-out plate 19 and a tray pull plate 20 reciprocate. In the forward movement of these plates, the stack of postal matter A is pushed out to the front to be fed to an aligned end converter 23 of an aligned end converting unit 22 which defines the forward end of a common convey line 21. In the backward movement, the empty tray 15 is pulled backward and is fed to the forward side of a tray return path 24 of the tray circulating section 14.

The stack of postal matter A fed to the convey line 21 is conveyed by an aligning convey unit 25 defining the convey line 21. During this process, the end of the stack of postal matter A opposite to the direction of the conveying movement and the end of the stack of postal matter A perpendicular to the direction of the conveying operation are aligned. The aligned stack of postal matter A is placed on a separate convey line 27 by a transfer mechanism 26 which extends perpendicularly to the convey line 21. An address card 29 is attached to the uppermost postal matter of the stack by an address card issuance and attachment unit 28 which is arranged in opposition to the convey line 21. The stack of postal matter A with the address card 29 attached thereto is fed to a binder 30 which is arranged at the terminal end of the convey line 27, so that the stack of postal matter A is bound thereby.

On the other hand, the tray 15 which is fed to the tray return path 24 by the postal matter/tray separating mechanism 18 is conveyed to an elevator mechanism 31 which is arranged at the front ends of the horizontal tray convey paths 13*a*, 13*b* and 13*c*. The tray 15 is then transferred to a tray mounting table 32 of the elevator mechanism 31 by the tray transfer mechanism (not shown) which is arranged in opposition to the terminal end of the tray return path 24. The elevator mechanism 31 intermittently circulates the tray mounting table 32 so as to sequentially vertically place it in opposition to the front ends of the horizontal tray convey paths 13*a*, 13*b* and 13*c*. The tray 15 which is opposed to the front end of the horizontal tray convey path 13*a*, 13*b* or 13*c* is pushed in the tray horizontal convey path 13*a*, 13*b* or 13*c* sequentially by the push-in mechanism (not shown). Upon this operation, the trays 15 in the horizontal tray convey paths 13*a*, 13*b* and 13*c* are transferred by one pitch, and the tray 15 at the terminal end is transferred to the tray mounting table 16 of the elevator mechanism 17. The overall system is controlled by a control section 33.

Figure 3:
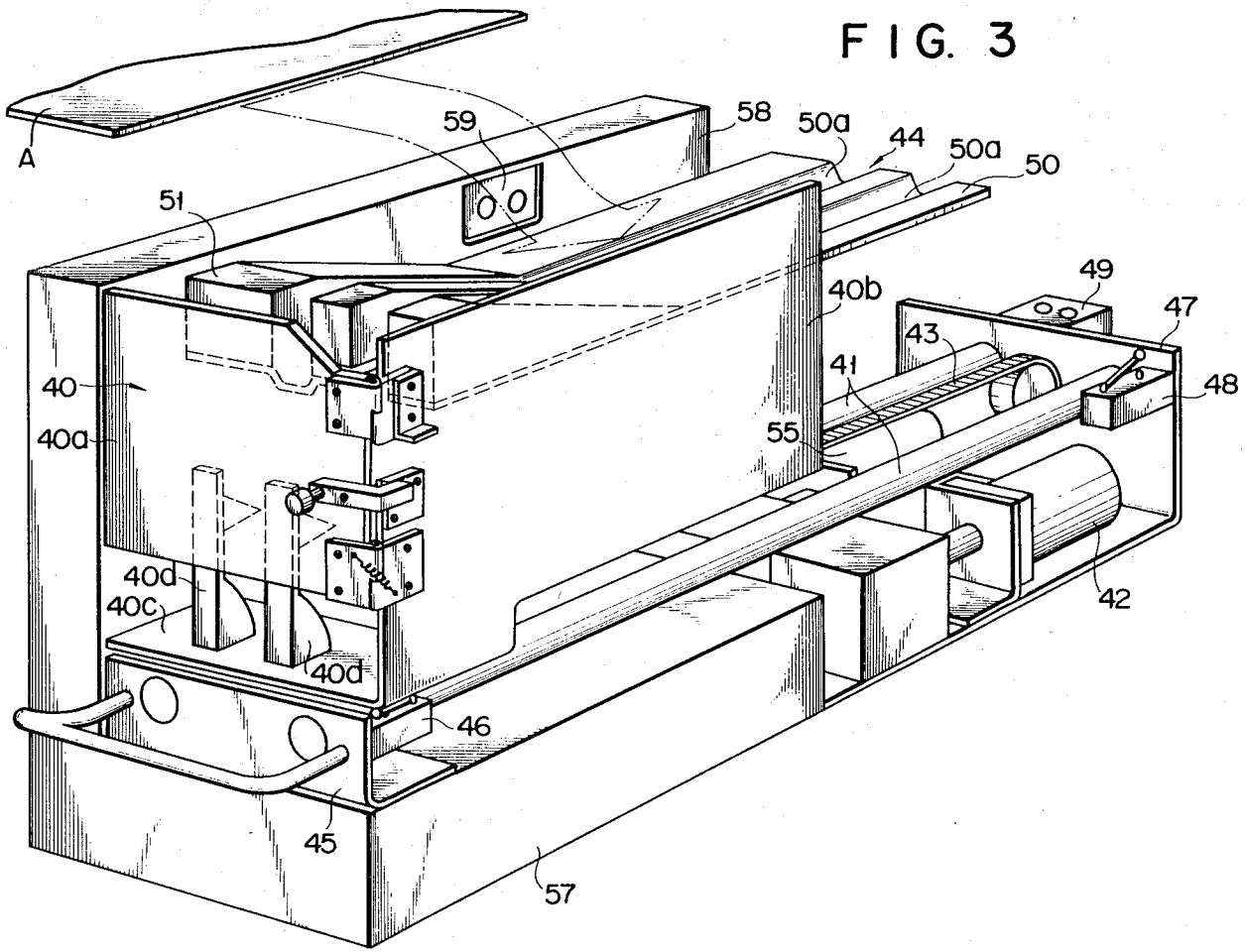
FIGS. 3 and 4 are perspective views showing the stacking section of the embodiment shown in FIG. 1.
Figure 4:
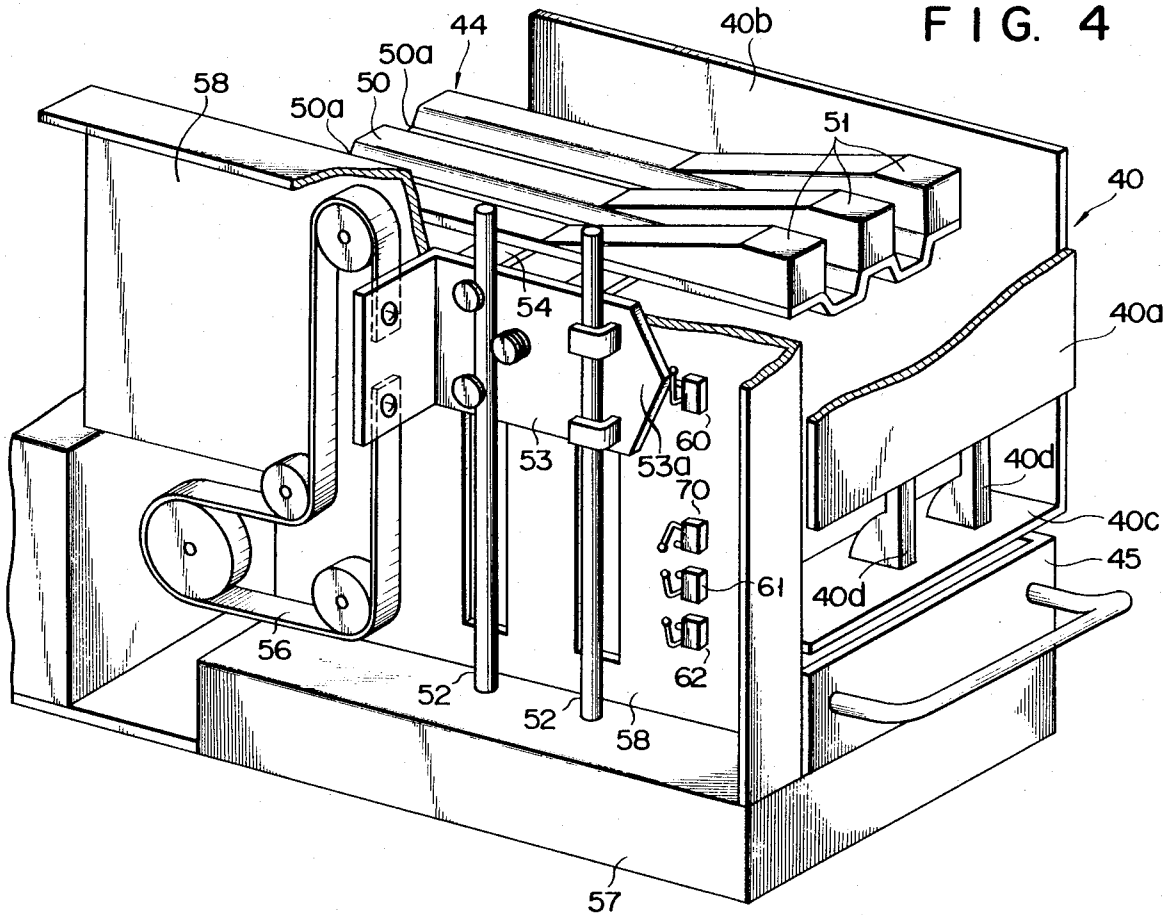

The stacking sections 10 and preliminary stacking section 100 will now be described in more detail with reference to FIGS. 3 and 4.

A push-out section 40 comprises a push-out plate 40*a* which also functions as a front cover, a side plate 40*b*, a bottom plate 40*c*, and an inclined holding member 40*d*. The push-out section 40 is reciprocally movable since the bottom plate 40*c* is supported on guide rails 41. A belt 43 which is driven by a reversible motor 42 is coupled to the bottom plate 40*c* of the push-out section 40. When the reversible motor 42 is driven in the forward or reverse direction, the push-out section 40 moves along the longitudinal direction of a mounting table 44 in the forward or reverse direction. A stop-position detector 46 for detecting if the push-out section 40 is in its stop position (stacking position of postal matter A) is arranged in the vicinity of one plate 47 which supports the guide rails 41. A return-position detector 48 for detecting if the push-out section 40 is at its return position (push-out operation is completed) is arranged in the vicinity of the other plate 47 supporting the guide rails 41. The detectors 46 and 48 are turned on and off by the projection (not shown) formed on the bottom plate 40*c* of the push-out section 40 in order to detect the position of the push-out section 40. An empty-stack detector 49 for detecting if the postal matter A is in the tray 15 is arranged on the plate 47 opposite the guide rails 41. The empty-stack detector 49 comprises, for example, a light-emitting element and a light-receiving element.

The mounting table 44 comprises a plate with guide grooves 50*a* for guiding the inclined holding member 40*d*, and an inclined member 51 which is arranged at the top of the plate 50 excluding the guide grooves 50*a* and at the side of the push-out plate 40*a*. The postal matter A is conveyed from the horizontal sorting paths 8*a*, 8*b*, and 8*c*. The mounting table 44 is mounted on a lateral plate 54 which is fixed to a carriage 53 which is, in turn, supported by guide rails 52 to be vertically movable. A belt 56 which is driven by a reversible motor 55 is coupled to the carriage 53. The mounting table 44 is vertically moved when the reversible motor 55 is driven in the forward or reverse direction. A control circuit 57 for controlling the overall stacking sections 10 is arranged below the push-out section 40. A side plate 58 which opposes a side 40*b* of the push-out section 40 is arranged above the control circuit 57. A postal matter detector 59 which detects postal matter A placed on the mounting table 44 is arranged at the upper center of the side plate 58. The postal matter detector 59 is a threshold reflecting type detecting element which consists of a light-emitting element and a light-receiving element. On the side plate 58 are also arranged an upper limit detector 60, a push-out permission detector 70, a full-stack detector 61, and a lower limit detector 62 which detect the position of the mounting table 44 in accordance with the movement of the carriage 53. The upper limit detector 60 detects if the mounting table 44 is at the position of the upper limit (initial status). The push-out permission detector 70 detects if the push-out (take-out) of the stack of postal matter A is possible. The full-stack detector 61 detects if the mounting table 44 is full of postal matter. The lower limit detector 62 detects if the mounting table 44 is at the lower limit position (push-out position). The detectors 46, 48, 60, 61, 62 and 70 respectively comprises microswitches. The microswitches 60, 61, 62 and 70 are arranged along the path of movement of the carriage 53 and are operated by a projection 53*a* of the carriage 53.

Figure 5:
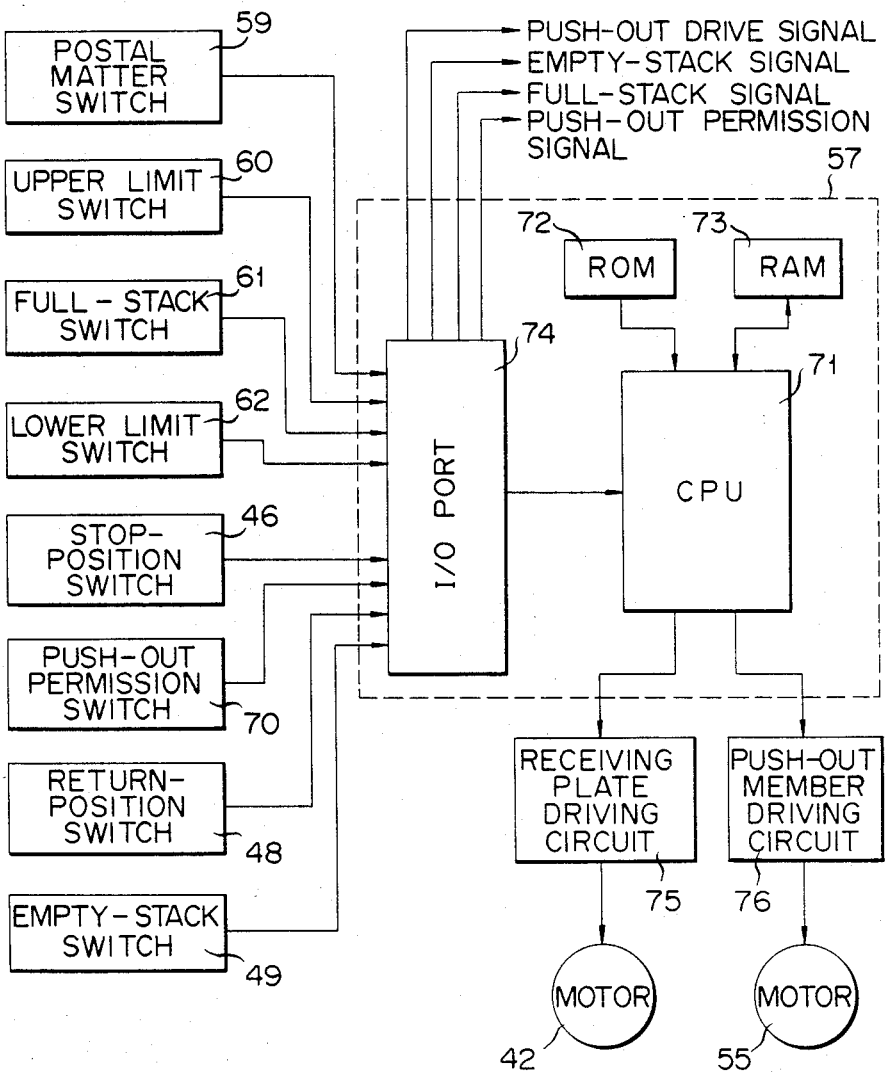
FIG. 5 is a block diagram of the circuitry of the stacking section.

FIG. 5 shows the block diagram of the circuitry of the stacking sections 10 and preliminary stacking section 100. The control circuit 57 comprises a central processing unit 71, a read-only memory 72 for storing control programs, a random access memory 73 for storing data to be processed, and an I/O port 74 for reading in the data from the detectors 59 to 62, 46, 70, 48 and 49. In response to the detection signal from the postal matter detector 59, the control circuit 57 drives the motor 55 in the forward direction through the push-out member driving detector 59. Thus, the mounting table 44 is lowered by the distance corresponding to the number of pieces of postal matter. When the detection signal is received from the empty-stack detector 49 to the control circuit 57 from the time when the detection signal from the push-out permission detector 70 is received until the time when the detection signal from the full-stack detector 61 is supplied, the control circuit 57 drives the motor 55 in the forward direction through the push-out member driving circuit 76 so as to lower the mounting table 44. In response to the detection signal from the lower limit detector 62, the control circuit 57 drives the motor 42 in the forward direction to move the push-out section 40 in the forward direction. Alternatively, in response to the detection signal from the full-stack detector 61, the control circuit 57 drives the motor 55 in the forward direction to lower the motor 55 until the detection signal from the lower limit detector 62 is supplied. Thereafter, in response to the detection signal from the empty-stack detector 49, the control circuit 57 drives the motor 42 in the forward direction through the receiving plate driving circuit 75 so as to move the push-out section 40 in the forward direction. The control circuit 57 further drives the motor 42 in the reverse direction from the time when the detection signal is supplied from the return-position detector 48 until the time when the detection signal is supplied from the stop-position detector 46. Then, the control circuit 57 drives the motor 55 in the reverse direction to raise the mounting table 44 to the initial position from the time when the detection signal is supplied from the stop-position detector 46 until the time when the detection signal is supplied from the lower limit detector 60. Further, the control circuit 57 drives the motor 42 in the reverse direction to move the push-out section 40 to the predetermined position in the reverse direction from the time when the detection signal is supplied from the return-position detector 48 until the time when the detection signal is supplied from the stop-position detector 46.

Figure 6:
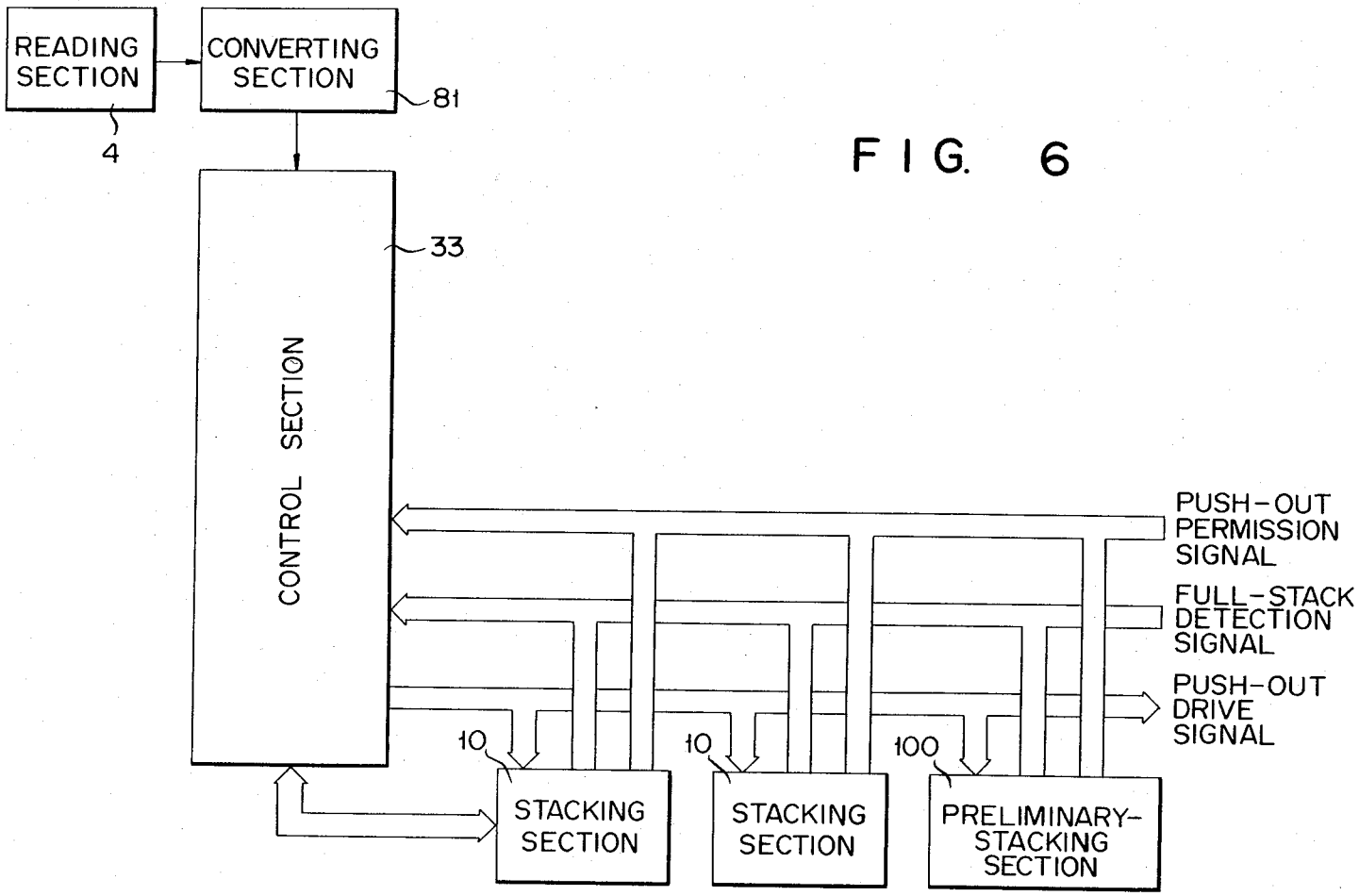
FIG. 6 is a block diagram of the overall circuit.
Figure 7:
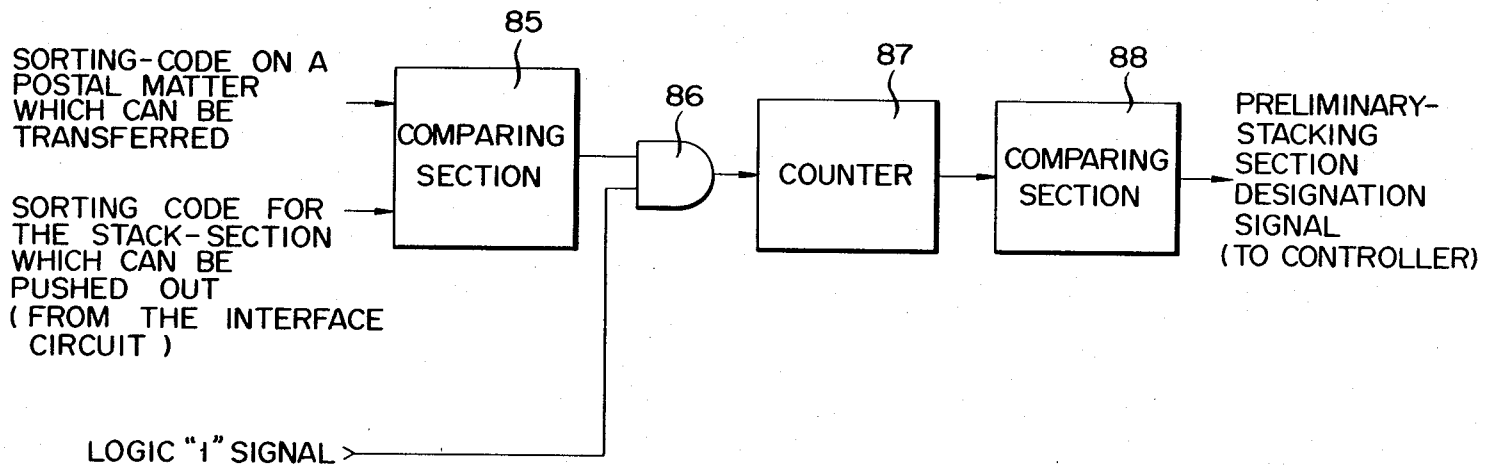
FIG. 7 is a block diagram of the determination circuit.
Figure 8:
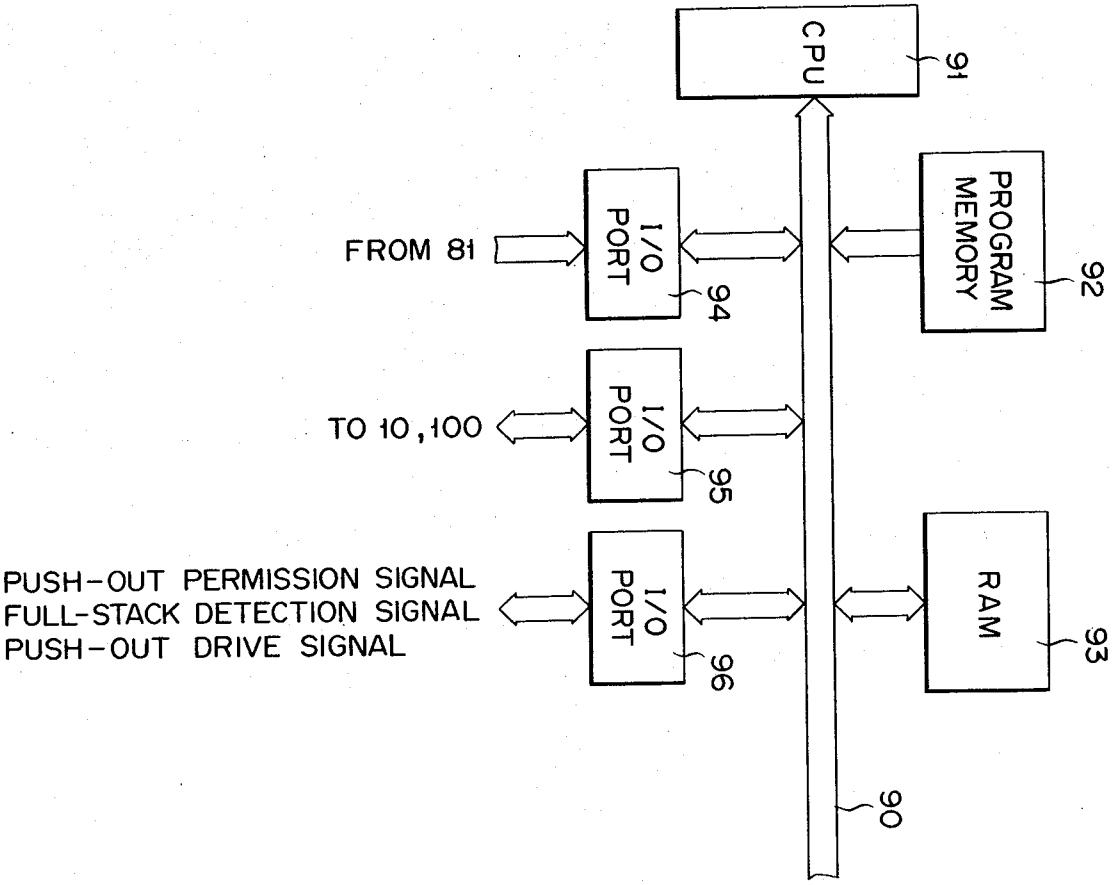
FIG. 8 is a detailed block diagram of the control section shown in FIG. 6.

FIG. 6 is a block diagram of the overall circuitry of the system. A converting section 81 converts the read-out result from the reading section 4, that is, the postal code number into the sorting code of the corresponding stacking section 10. The output from the converting section 81 is supplied to a control section 33. As shown in FIG. 8, the control section 33 comprises a central processing unit (CPU) 91, a read-only memory (ROM) 92 storing control programs, a random access memory (RAM) 93, and a plurality of I/O ports 94, 95, 96 and 97. These devices 91, 92, 93, 94, 95, 96 and 97 are connected to one another through an internal bus 90. The CPU 91 is connected to the converting section 81 through the I/O port 94 to receive the sorting code from the converting section 81 and to supply the sorting code to the stacking section 10 and a preliminary stacking section 100 through the I/O port 95. In response to the push-out permission signal, the control section 33 determines that the push-out operation can be performed. In response to the full-stack signal, the control section 33 determines that the corresponding stacking section is full. In response to the empty-stack detection signal corresponding to a stacking section 10, the control section 33 outputs a push-out drive signal to this stacking section 10. In response to the sorting code, the control section 33 controls the sorting operation of the postal matter A. When the sorting code of a stacking section 10 is supplied within the push-out time duration of the stacking section 10, the corresponding postal matter A is stacked at the preliminary stacking section 100. When stacking section 10 is restored to the initial status, the control section 33 outputs a push-out drive signal to the preliminary stacking section 100.

The mode of operation of the embodiment of this configuration will be described. The postal matter A set at the feeding section 1 is sequentially picked up by the pickup section 2 and conveyed by the feed-in convey path 3. During the convey operation, the postal code numbers provided on the postal matter A are read out by the reading section 4. The readout postal code number is converted to the sorting code by the converting section 81 and is supplied to the control section 33. Based on the received sorting code, the control section 33 controls the convey operation and the sorting operation so that the postal code A corresponding to the sorting code may be stacked at the corresponding stacking section 10. Thereafter, the postal matter A sequentially picked up from the feeding section 1 is stacked at the stacking sections corresponding to the postal code numbers corresponding thereto.

When the postal matter A is supplied to the predetermined stacking section 10 and a predetermined number of pieces of postal matter A are placed on the mounting table 44, the postal matter detector 59 detects the postal matter A and produces a detection signal. In response to this detection signal, the control circuit 57 drives the motor 55 in the forward direction to lower the mounting table 44 by the distance corresponding to the predetermined number of pieces of postal matter A. Every time a new piece of postal matter A is supplied, the above operation is repeated. When a plurality of pieces of postal matter A are stacked at the push-out permission position before the full-stack status, the push-out permission detector 61 detects this and the control circuit 57 outputs a push-out permission signal.

As a consequence, when the empty-stack detection signal for the corresponding stacking section 10 is supplied from the control circuit 57, the control section 33 supplies the push-out drive signal to this stacking section 10. Then, the control circuit 57 drives the motor 55 in the forward direction to lower the mounting table 44. In response to the detection signal from the lower limit detector 62, the control circuit 57 stops the motor 55 and drives the motor 42 in the forward direction so as to move the push-out section 40 in the longitudinal direction of the mounting table 44. Thus, the postal matter A is pushed out to the rear side of the sorter 7 with an automatic push-out function by the push-out plate 40*a* and is transferred to the tray 15. When this transfer is completed, the detection signal is outputted from the return-position detector 48 by the engagement with the projection on the bottom plate 40*c* of the push-out section 40. In response to this detection signal, the control circuit 57 drives the motor 55 in the reverse direction to raise the mounting table 44 and also drives the motor 42 in the reverse direction to move the push-out section 40 along the longitudinal direction of the push-out section 40.

When the mounting table 44 is restored to the initial position, the upper limit detector 60 detects this and the control circuit 57 stops the motor 55. When the push-out section 40 is brought to the predetermined position, the detection signal is outputted from the stop-position detector 46 by the engagement with the projection on the bottom plate 40*c* of the push-out section 40, and the control circuit 47 stops the motor 42 to stop the movement of the push-out section 40.

Assume that the push-out command signal is not outputted and the push-out drive signal is not outputted from the control section 33, from the time when the detection signal is supplied from the push-out permission detector 70 until the time when the detection signal is supplied from the full-stack detector 61. In this case, the control circuit 57 produces a full-stack signal in response to the detection signal from the full-stack detector 61. When the empty-stack detection signal is next supplied from the control circuit 57 of the corresponding stacking section 10, the control section 33 outputs the push-out drive signal to the corresponding stacking section 10. As a result, at the stacking section 10, the control circuit 57 drives the motor 55 in the forward direction to descend the mounting table 44. Thereafter, the operation as in the case when the postal matter A is transferred before the full-stack status is performed, so that the postal matter A in the full stacking section 10 is transferred to the corresponding tray 15.

When the sorting code of the stacking section 10 which is involved in the push-out operation is supplied to the control circuit 33 during the push-out time duration, the control section 33 controls the sorting operation so that the corresponding postal matter A is stacked at the preliminary stacking section 100. The other pieces of the postal matter A are also stacked at the corresponding stacking sections 10. When the stacking section 10 described above completes the push-out operation and is restored to the status which allows stacking of the postal matter, the corresponding postal matter A is stacked at this stacking section. When the stacking section 10 is restored, the control section 33 produces a push-out drive signal to the preliminary stacking section 100. Then, at the preliminary stacking section 100, the control circuit 57 drives the motor 55 in the forward direction to lower the mounting table 44. Thereafter, the operation as in the case of the transfer of the postal matter A before the full-stack status is performed to transfer to the corresponding tray 15 the postal matter A stacked at the preliminary stacking section 100.

In this manner, after the number of pieces of postal matter A stacked at a stacking section 10 reaches a suitable number which allows the push-out operation before or after the full-stack status, postal mail A is transferred to the corresponding tray 15. The postal matter A to be stacked at this stacking section 10 during this push-out operation is then stacked at the preliminary stacking section 100. After the stacking section 10 is restored, the postal matter A is transferred to the corresponding empty tray 15, so that the waiting time during the push-out operation of the postal matter may be reduced to the minimum and the number of pieces of postal matter to be rejected during this push-out time may be reduced.

In the embodiment described above, the transfer section is arranged at the rear side of the stacking section. However, the present invention is not limited to this. For example, the transfer section may be arranged at the front side or below the stacking sections for achieving the same effects.

The embodiments merely examplify the invention which may, of course, be constructed in various other forms, some of which may be quite different from the disclosed illustrative embodiments.

However, specific structure and functional details disclosed herein are merely representative and in that regard provide a basis for the claims herein which define the scope of the invention.

What we claim is:

1. A sorter for sorting documents having sorting information contained thereon comprising:

conveying means for sequentially conveying said documents along a predetermined sort path;

a stacking section including at least one row of stationary stacking bins disposed along said sort path, said row of stacking bins including plural primary stacking bins and an auxiliary stacking bin each for receiving a stack of sorted documents;

reading means disposed along said sort path upstream of said stacking section for reading said sorting information on said documents;

sorting means operatively connected to said reading means for assigning said documents to respective ones of said stacking bins to thereby stack and sort said documents;

a transfer section including at least one row of transfer bins, said transfer bins being movable relative to said primary and auxiliary stacking bins so as to be registrable therewith to receive said stacked and sorted documents therefrom;

plural primary removing means operatively associated with each of said primary stacking bins for transferring said sorted and stacked documents in said primary stacking bins to a predetermined first one of said transfer bins;

auxiliary removing means operatively associated with said auxiliary stacking bin for transferring said sorted and stacked documents in said auxiliary stacking bin to a predetermined second one of said transfer bins; and control means operatively connected to each said primary removing means and said auxiliary removing means for sequentially (a) determining when a selected number of documents are stacked in each said primary stacking bin, (b) operating said primary removing means of a respective one of said primary stacking bins in response to said selected number being determined to transfer said selected number of stacked documents therein to said predetermined first one of said transfer bins while simultaneously diverting those documents assigned to said respective one of said primary stacking bins by said sorting means to said auxiliary stacking bin, (c) determining when said selected number of stacked documents have been transferred from said respective one of said primary stacking bins to said predetermined first one of said transfer bins, (d) operating said auxiliary removing means, in response to determining the completion of said transfer of stacked documents in said respective one of said primary stacking bins to said predetermined first one of said transfer bins, to transfer the documents stacked in said auxiliary stacking bin to said predetermined second one of said transfer bins while simultaneously permitting said documents assigned to said selected one of said primary stacking bins by said sorting means to once again be stacked in said selected one of said primary stacking bins.

* * * * *